US010982848B2

(12) United States Patent
Anwar

(10) Patent No.: US 10,982,848 B2
(45) Date of Patent: Apr. 20, 2021

(54) BAFFLE DESIGN FOR FURNACE BURNER BOX

(71) Applicant: Carrier Corporation, Palm Beach Gardens, FL (US)

(72) Inventor: Fahad Anwar, Avon, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 80 days.

(21) Appl. No.: 16/418,549

(22) Filed: May 21, 2019

(65) Prior Publication Data

US 2019/0353347 A1 Nov. 21, 2019

Related U.S. Application Data

(60) Provisional application No. 62/674,327, filed on May 21, 2018.

(51) Int. Cl.

| | |
|---|---|
| ***F23D 14/70*** | (2006.01) |
| ***F23M 20/00*** | (2014.01) |
| ***F24D 19/10*** | (2006.01) |

(52) U.S. Cl.

CPC ..... *F23D 14/70* (2013.01); *F23M 20/005* (2015.01); *F24D 19/1084* (2013.01)

(58) Field of Classification Search

CPC ..... F24H 3/087; F24H 9/2085; F24H 9/1881; F24H 9/2035; F24H 3/06; F24H 3/065; F24H 3/105; F24H 9/0052; F24H 3/08; F24H 2240/06; F24H 9/02; F24H 2210/00; F24H 2240/00; F24H 3/006; F24H 8/00; F24H 8/006; F23D 14/70; F23D 14/08; F23D 14/62; F23D 1/00; F23D 14/02; F23D 14/04; F23D 14/045; F23D 14/46; F23D 14/58; F23D 14/76; F23D 2203/1017; F23D 2203/102; F23D 2203/105; F23D 2212/201; F23D 2900/00019; F23D 2900/14021; F23D 11/106; F23D 11/24; F23D 14/14; F23D 2203/101; F23D 2203/103;

(Continued)

(56) References Cited

U.S. PATENT DOCUMENTS

| | | | |
|---|---|---|---|
| 1,082,576 | A | 12/1913 | White et al. |
| 3,684,424 | A | 8/1972 | Smith et al. |

(Continued)

FOREIGN PATENT DOCUMENTS

| | | | |
|---|---|---|---|
| CN | 204494394 | U | 7/2015 |
| JP | 3717009 | B2 | 12/1997 |

(Continued)

*Primary Examiner* — Jason Lau

(74) *Attorney, Agent, or Firm* — Cantor Colburn LLP

(57) ABSTRACT

Disclosed is a baffle for a mixing region of a furnace burner box, the mixing region being a volume in the burner box defined in a transverse direction between a burner at a front portion of the burner box and an opposing a rear portion of the burner box, a longitudinal direction between opposing side surfaces of the burner box, and a height-wise direction between opposing top and bottom surfaces of the burner box, the baffle having: a first side which is a rear side, a second side which is a front side, the first side and the second side being spaced in the transverse direction, and wherein the baffle defines an indirect fluid passageway between the first side and the second side.

16 Claims, 4 Drawing Sheets

(58) Field of Classification Search
CPC ..... F23D 23/00; F23D 2900/00003; F24D 11/005; F24D 11/009; F24D 12/02; F24D 19/0095; F24D 19/1084; F24D 19/109; F24D 3/08; F24D 5/00; F24D 5/02; F24D 5/04; F24F 11/77; F24F 12/006; F24F 5/0096; F23M 20/005; F01N 1/00; F01N 1/083; F01N 1/10
See application file for complete search history.

(56) References Cited

U.S. PATENT DOCUMENTS

| | | | | |
|---|---|---|---|---|
| 4,029,462 | A | 6/1977 | Bitterlich | |
| 5,180,302 | A | 1/1993 | Schwartz et al. | |
| 5,580,238 | A | 12/1996 | Charles | |
| 6,106,276 | A * | 8/2000 | Sams | F23D 14/46 126/110 C |
| 6,126,436 | A | 10/2000 | Cabrera et al. | |
| 6,491,514 | B1 | 12/2002 | Hamad et al. | |
| 6,561,182 | B2 | 5/2003 | Wong | |
| 6,607,376 | B2 | 8/2003 | Poe | |
| 6,808,385 | B2 | 10/2004 | Garloch et al. | |
| 7,472,774 | B1 * | 1/2009 | Monson | F01N 1/04 181/251 |
| 7,635,264 | B2 | 12/2009 | Strobel et al. | |
| 7,992,676 | B1 | 8/2011 | Desjardins et al. | |
| 9,127,837 | B2 | 9/2015 | Proscia et al. | |
| 2014/0030662 | A1 | 1/2014 | Noman | |

FOREIGN PATENT DOCUMENTS

| | | |
|---|---|---|
| JP | 3471056 B2 | 11/2003 |
| JP | 4179761 B2 | 11/2008 |

* cited by examiner

BAFFLE DESIGN FOR FURNACE BURNER BOX

CROSS-REFERENCE TO RELATED APPLICATIONS

This application claims the benefit of U.S. provisional application 62/674,327 filed May 21, 2018, which is incorporated herein by reference in its entirety.

BACKGROUND

Exemplary embodiments pertain to the art of burner boxes within heating appliances (e.g. furnaces) and more specifically to a baffle design for a burner box.

Pre-mix burner systems in heating appliances may produce a tone at the time of ignition specifically during hot relight conditions. This may be from thermo-acoustical responses in the system due to rapid heat release in a short period of time. The noise may be generated due to a lack of up-stream (on the mixing side) impedance in the system.

BRIEF DESCRIPTION

Disclosed is an acoustical dampening baffle for a mixing region of a furnace burner box, the mixing region being a volume in the burner box defined in a transverse direction between a burner at a front portion of the burner box and an opposing a rear portion of the burner box, a longitudinal direction between opposing side surfaces of the burner box, and a height-wise direction between opposing top and bottom surfaces of the burner box, the baffle having: a first side which is a rear side, a second side which is a front side, the first side and the second side being spaced in the transverse direction, and wherein the baffle defines an indirect fluid passageway between the first side and the second side.

In addition to one or more of the above features or as an alternate the baffle includes a plurality of flow barrier walls, including a first flow barrier wall and a second flow barrier wall, the plurality of flow barrier walls extending in the longitudinal direction, being transversely spaced from each other and including a same geometric profile, wherein the plurality of flow barrier walls includes a respective plurality of flow-thru portions, including a first flow-thru portion on the first flow barrier wall and a second flow-thru portion on the second flow barrier wall, the plurality of flow-thru portions fluidly connecting the plurality of flow barrier walls in the transvers direction, and wherein in transversely adjacent ones of the plurality of flow barrier walls, the plurality of flow-thru portions are disposed on opposing longitudinal ends and are non-overlapping in the longitudinal direction.

In addition to one or more of the above features or as an alternate the plurality of flow barrier walls is evenly spaced in the transverse direction.

In addition to one or more of the above features or as an alternate each of the plurality of flow-thru portions comprises a total longitudinal span of less than fifty percent of a longitudinal span of each of the respective plurality of flow barrier walls.

In addition to one or more of the above features or as an alternate each of the plurality of flow-thru portions comprises a same longitudinal span.

In addition to one or more of the above features or as an alternate each of the plurality of flow-thru portions comprises a same configuration.

In addition to one or more of the above features or as an alternate the first flow-thru portion comprises a plurality of flow-thru orifices.

In addition to one or more of the above features or as an alternate each of the flow-thru orifices defines a respective flow-thru area, wherein the plurality of flow-thru orifices in the first flow-thru portion defines a total flow-thru area, wherein the total flow-thru area in the first flow-thru portion is less than fifty percent of a total surface area of the first flow-thru portion.

In addition to one or more of the above features or as an alternate the plurality of flow-thru orifices in the first flow-thru portion form a uniformly distributed rectangular array.

In addition to one or more of the above features or as an alternate the baffle includes a plurality of connector walls interconnecting each of the plurality of flow barrier walls, the plurality of connector walls extending in the transverse direction between opposing longitudinal ends of alternative ones of the plurality of flow barrier walls, so that the baffle has a boxed-serpentine shape in a plan view.

A furnace is disclosed having a burner box, the burner box including a mixing region, the mixing region being a volume in the burner box, the volume defined in a transverse direction between a burner at a front portion of the burner box and an opposing a rear portion of the burner box, a longitudinal direction between opposing side surfaces of the burner box, and a height-wise direction between opposing top and bottom surfaces of the burner box, the mixing region including a baffle having one or more of the above disclosed features.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
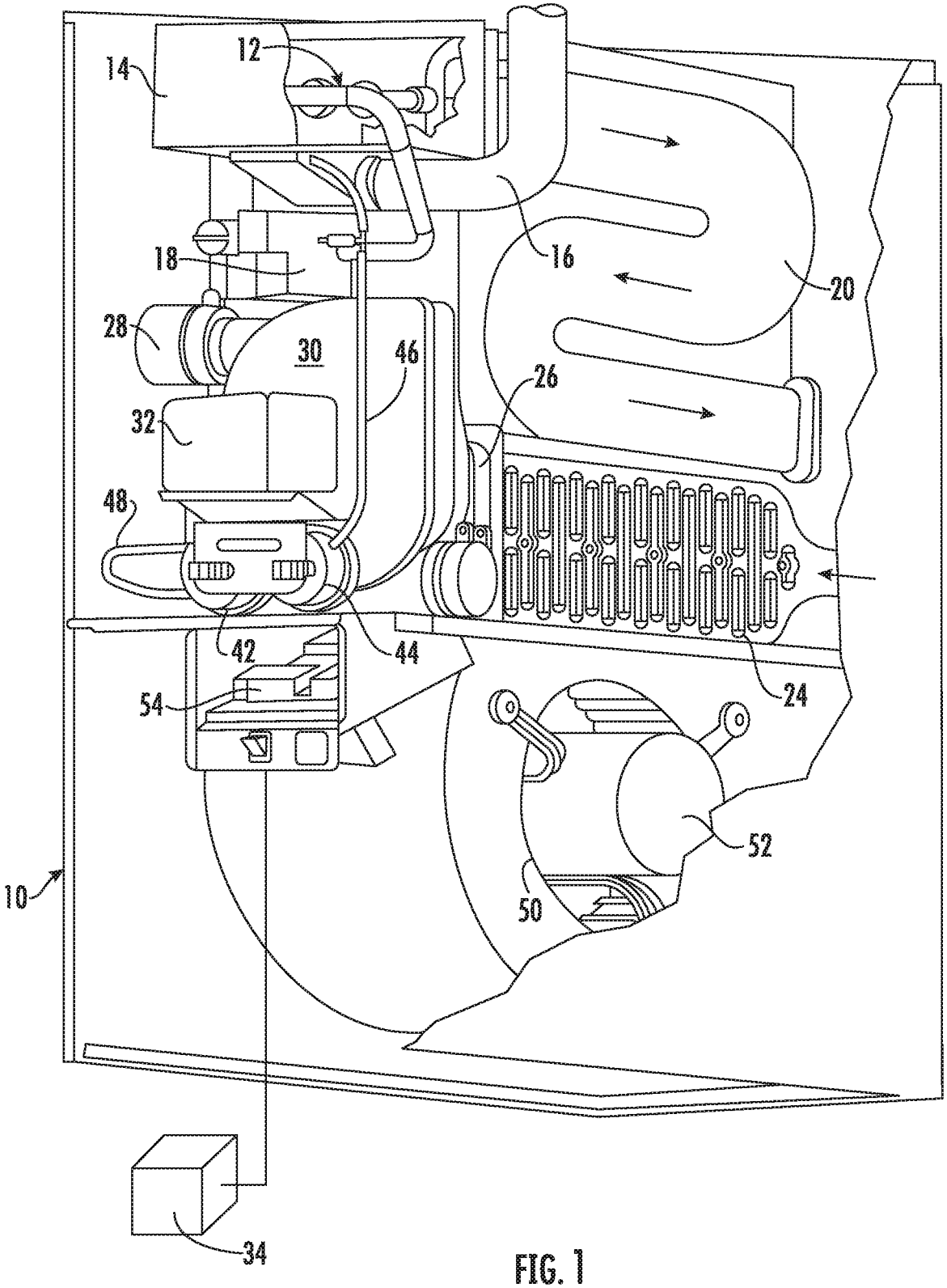
FIG. 1 is a perspective cutaway view of a two-stage condensing furnace according to a disclosed embodiment.

FIG. 1 is a perspective cutaway view of a conventional two-stage condensing furnace 10. The furnace 10 may include a burner assembly 12, a burner box 14, an air supply duct 16 and a gas valve 18. The burner assembly 12 may be located within the burner box 14 and may be supplied with air through the air supply duct 16. Fuel gas may be supplied to the burner assembly 12 through the gas valve 18, and fuel may be ignited by an igniter assembly 162 (shown in FIG. 4). The gas valve 18 may comprise a conventional solenoid-operated two-stage gas valve. The gas valve 18 for the two-stage furnace may have a closed state, a high open state associated with the operation of furnace 10 at its high firing rate, and a low open state associated with the operation of furnace 10 at its low firing rate.

The furnace 10 may include a heat exchanger assembly, which may include a plurality of heat exchangers including a primary or non-condensing heat exchanger 20 and a secondary or condensing heat exchanger 24. The furnace 10 may further include a condensate collector box 26, an exhaust vent 28, an induced draft blower 30 and an inducer motor 32. The inducer motor 32, one of a plurality of motors in the furnace 10, may drive the induced draft blower 30. Gases produced by combustion within the burner box 14 may flow through the plurality of heat exchangers, the condensate collector box 26 and may then be vented to the atmosphere through the exhaust vent 28. The flow of these gases, alternatively referred to as combustion gases, may be maintained by the induced draft blower 30.

The two-stage furnace 10 may further include a thermostat 34, a plurality of pressure switches including a low pressure switch 42 and a high pressure switch 44, and a plurality of pressure tubes including a first pressure tube 46 and a second pressure tube 48. Excess air levels in the furnace 10 may be kept within an acceptable lower limit in part by the low pressure switch 42. Excess air levels in the furnace 10 may be kept within an acceptable higher limit in part by the high pressure switch 44. To sense pressure at the inlet of the primary heat exchanger 20, the plurality of pressure switches may be connected to the burner box 14 through a pressure tube 46. To sense pressure at the outlet of the secondary heat exchanger 24, the plurality of pressure switches 42 and 44 may be connected to collector box 26 through the pressure tube 48.

The furnace 10 may further include a blower 50 and a blower motor 52. The blower motor 52, another of the plurality of motors in the furnace 10, may drive the blower 50. The blower 50 may draw in air, and air discharged from the blower 50, alternatively referred to as circulating air flow, and may then pass over the plurality of heat exchangers in a counter-flow relationship to the flow of combustion air. The circulating airflow may be thereafter directed to a space to be heated through a duct system (not shown).

The plurality of motors may operate at a low speed when the furnace is operating at its low firing rate (low stage operation). The plurality of motors may operate at a high speed when the furnace is operating at its high firing rate (high stage operation). The plurality of motors may be designed to operate at continuously variable speeds. Alternatively, for the two stage furnace 10 the plurality of motors may be designed to selectively operate and at a plurality of operating speeds including a steady state low operating speed and a steady state high operating speed.

The furnace 10 may include a furnace controller 54 that, in part, may selectively control the operating speed of the plurality of motors by generating and transmitting control signals. For example, depending on operating conditions, the furnace controller 54 may select a speed from the plurality of operating speeds for the plurality of motors. In addition, the furnace controller 54 may select a time, duration, ramp rate, and torque at which the plurality of motors accelerate to and decelerate from the selected speed.

The combustion efficiency of an induced-draft gas-fired furnace may be optimized by maintaining the proper ratio of the gas input rate and the combustion airflow rate. Generally, the ideal ratio may be offset somewhat for safety purposes by providing for slightly more combustion air (that is, excess air) than that required for optimum combustion efficiency. While FIG. 1 illustrates a condensing furnace (that is, a furnace that uses a heat exchanger assembly that includes primary and secondary heat exchangers), the accompanying disclosure may be also applicable to non-condensing furnaces (that is, furnaces that have heat exchanger assemblies with only a single heat exchanger unit), and packaged units (a furnace and air conditioner/heat pump combination in a single enclosure).

In the following sample use cases, the furnace control 54 may determine the requirements from the low pressure switch 42 and high pressure switch 44 in response to call-for-heat signals received from the thermostat 34 located in the space to be heated. From this determination the furnace control 54 may generate speed control signals to drive inducer motor 32.

In a first sample use case, when the thermostat 34 provides a call-for-heat signal to the furnace control 54, the furnace control 54 may determine that furnace 10 is to operate at the low firing rate. The furnace control 54 may accelerate the inducer motor 32 to a first pre-ignition speed. The first pre-ignition speed for the inducer motor 32 may be a first pre-ignition steady state speed that may corresponding to a first pre-ignition differential pressure for the heat exchanger assembly. The first pre-ignition differential pressure for the heat exchanger assembly may be sufficient to actuate the low pressure switch 42, but not the high pressure switch 44.

When the first differential pressure for the heat exchanger assembly has been sustained for a preset time, the gas valve 18 may actuate to its low open state. Under this condition, the gas valve 18 may supply gas at the low firing rate to the burner assembly 12. The gas is ignited and begins heating the combustion gases passing through the heat exchanger assembly. This heating may cause a change in the density of the combustion air which, in turn, may causes an increase in the differential pressure across the heat exchange assembly.

The speed of the inducer motor 32 may be then reduced to a first post-ignition speed. The first post-ignition speed for the inducer motor 32 is a first post-ignition steady state speed that corresponds to a first post ignition differential pressure for the heat exchanger assembly. The first post-ignition differential pressure for the heat exchanger assembly is somewhat lower than the first pre-ignition value.

After reducing the speed of inducer motor 32 to the first post-ignition speed, furnace control 54 may provide a signal that causes blower motor 52 to accelerate to a first post-ignition speed. The first post-ignition speed for the blower motor 52 may be a first steady state speed that corresponds to a circulating airflow at which the furnace 10 may be designed to operate during low stage operations.

In a second sample use case, when the thermostat 34 provides a call-for-heat signal to furnace control 54, the furnace control 54 may determine that furnace 10 is to operate at the high firing rate. The furnace control 54 may accelerate the inducer motor 32 to a second pre-ignition speed. The second pre-ignition speed for the inducer motor 32 may be a second pre-ignition steady state speed that may correspond to a second pre-ignition differential pressure for the heat exchanger assembly. The second pre-ignition speed for the inducer motor 32 may be sufficient to actuate both low pressure switch 42 and high pressure switch 44.

When the second pre-ignition differential pressure for the heat exchanger assembly has been sustained for a preset time, the gas valve 18 may be actuated to the high open state. Under this condition, the gas valve 18 may supply gas at the high firing rate to burner assembly 12. The gas may be ignited and begin heating the combustion gases passing through the heat exchanger assembly. This heating may cause a change in the density of the combustion gases which, in turn, may cause an increase in the differential pressure across the heat exchange assembly.

The speed of inducer motor 32 may then be increased (rather than decreased as in the first sample use case) to a second post-ignition speed to attain a second post-ignition steady state speed. The second post-ignition steady state speed may correspond to a second post-ignition differential pressure for the heat exchanger assembly that is somewhat higher than the pre-ignition value. After moving the speed of inducer motor 32 to the second post-ignition speed, furnace control 54 may cause blower motor 52 to accelerate to a second blower motor speed. The second post-ignition speed for the blower motor 52 is may be a second steady state speed that may correspond to the circulating airflow value at which furnace 10 is designed to operate.

In order to reduce the operating cost of furnace 10 by improving its annual fuel utilization efficiency (AFUE), the combustion airflow for furnace 10 may be adapted to provide for intermediate stages of operation between the low stage of operation and the high stage of operation. This may be accomplished by providing one or more additional pressure switches that actuate at heat exchanger pressure levels intermediate that of the plurality of pressure switches. Circuitry in the furnace control 54, however, may be limited to two inputs on which the plurality of pressure switches may provide pressure signals related to the pressure in the heat exchanger assembly.

Figure 2:
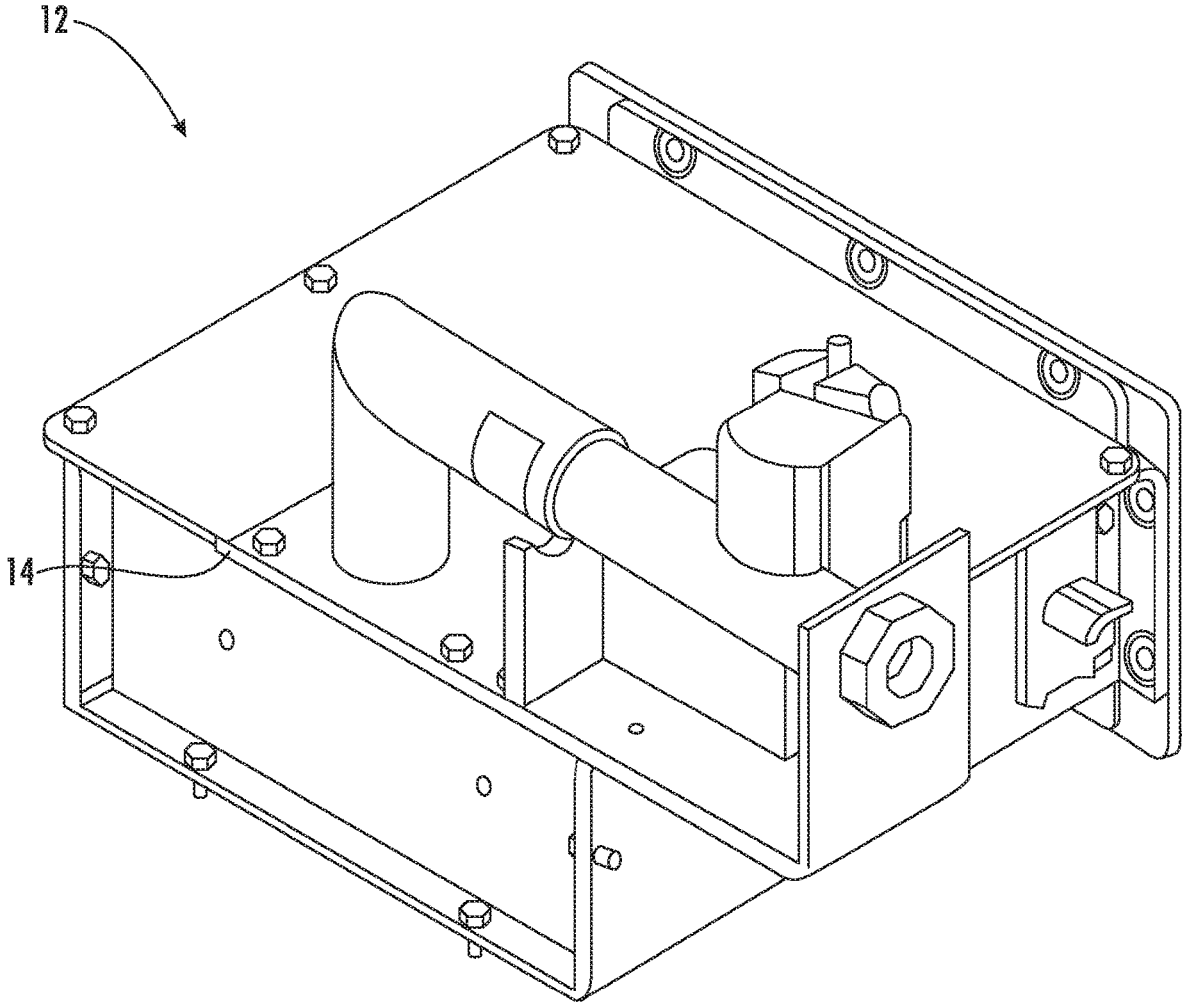
FIG. 2 is a perspective view of a burner box according to a disclosed embodiment.
Figure 3:
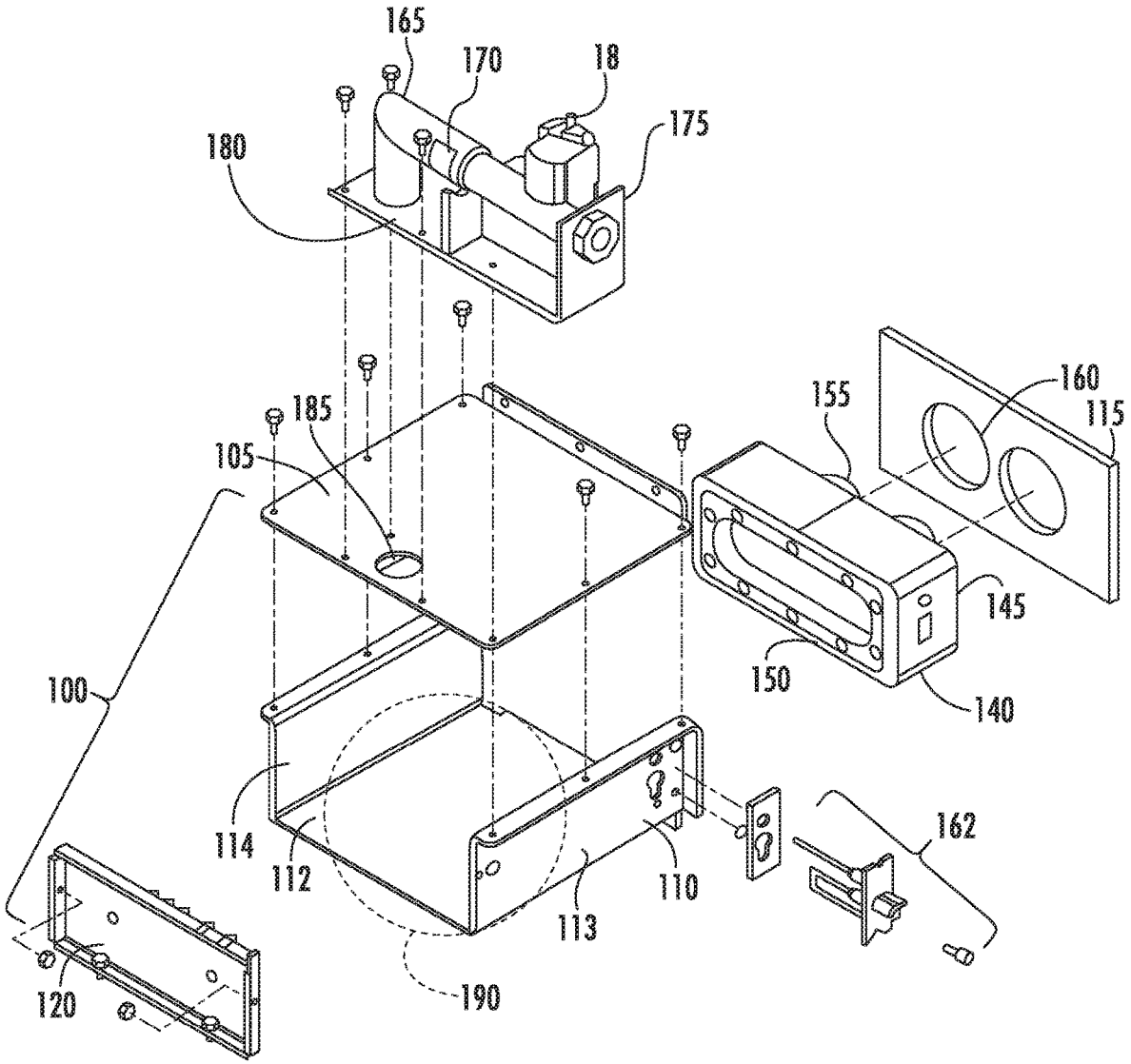
FIG. 3 is an exploded view of a burner box according to a disclosed embodiment.

Turning to FIGS. 2-3 the burner assembly 12 is further illustrated. The burner assembly 12 may generally include the burner box 14 comprised of a burner box assembly 100 that may include a top plate or top surface 105 and a substantially squared "U" member 110. The substantially squared "U" member 110 may form a bottom surface 112 that opposes the top surface 105, a first side surface 113 and an opposing second side surface 114. The burner box 14 may also include a front plate or front surface 115 at a front portion of the burner box 14 and an opposing rear plate or rear surface 120 at a rear portion of the burner box 14.

A burner 140 or combustion chamber may be disposed adjacent the front surface 115. The burner 140 may have a rectangular box shape having a front side 145 and a rear side 150. The rear side 150 of the burner 140 may face into the burner box 14. The front side 145 of the burner 140 may be proximate the front surface 115 of the burner box 14. The burner 140 may have a plurality of exit conduits including a first conduit 155 fluidly communicating products of combustion and the front surface 115. The burner box 14 may have a corresponding plurality of orifices including a first orifice 160. The plurality of exit conduits of the burner box 14 may extend through the plurality of orifices in the front surface 115 of the burner box 14.

Mounted to the top surface 105 of the burner box 14 there may be the gas valve 18 and a mixing conduit 165. The mixing conduit 165 may have an air slot 170 proximate the gas valve 18. The air slot 170 may receive air from operation of the inducer motor 32. A bracket 175 may support the gas valve 18 and the mixing conduit 165 against the burner box 14. The mixing conduit 165 may have an exit orifice 180 fluidly connected to a corresponding fuel inlet orifice 185 in the top surface 105 of the burner box 14. Within the burner box 14, a mixing region 190 may be defined in the volume behind the burner 140. The volume may be between the rear side 150 of the burner and the rear surface 120 of the burner box 14, opposing first and second side surfaces 113, 114 of the burner box 14, and opposing top and bottom surfaces 110, 112 of the burner box 14.

Figure 4:
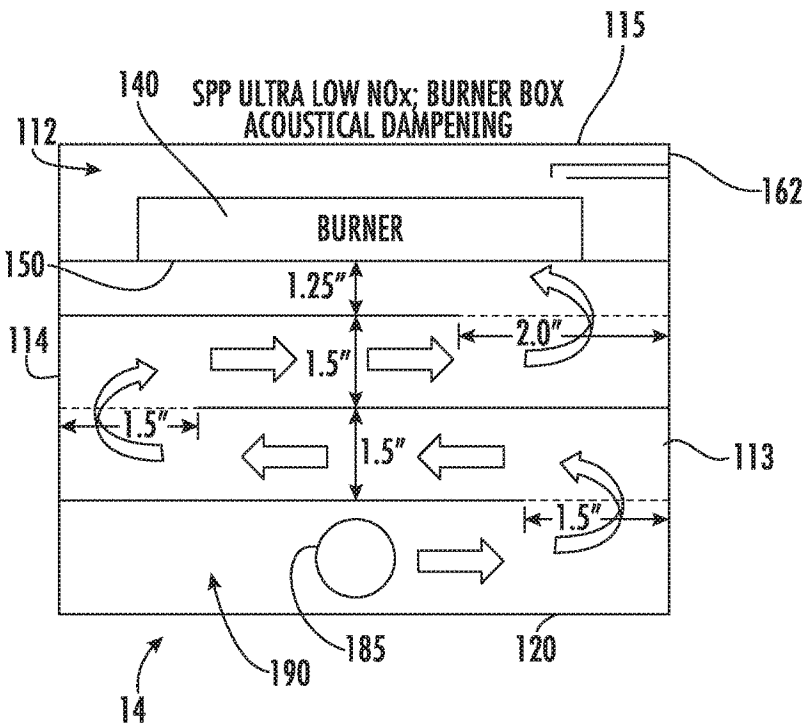
FIG. 4 is a schematic-plan view of a burner box according to a disclosed embodiment.

FIG. 4 illustrates the burner box 14, including the front surface 115, the rear surface 120, the opposing first and second side surfaces 113, 114, the bottom surface 112, along with the burner 140 and the igniter assembly 162. The fuel inlet orifice 185 in the top surface 105 is also illustrated. The mixing region 190, as illustrated in FIG. 4, may have a rectangular plan (top) area.

Figure 5:
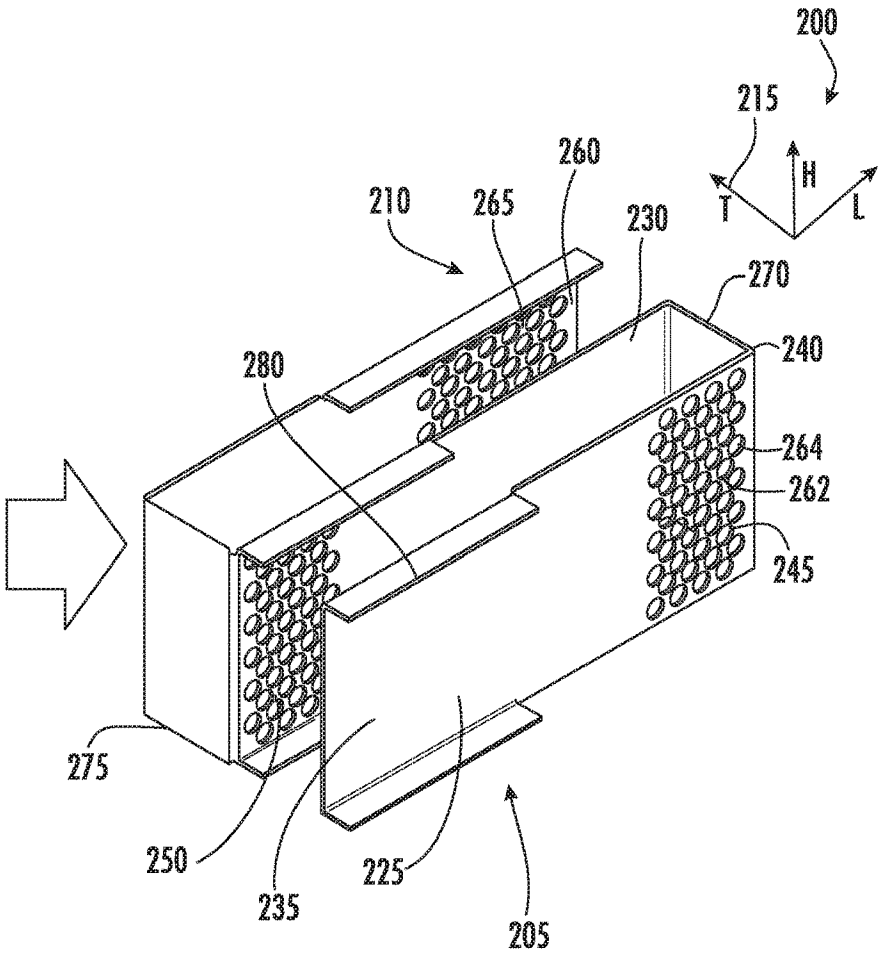
FIG. 5 is a perspective view of a baffle according to a disclosed embodiment.

According to a disclosed embodiment, in the burner box 14 for the furnace 10 the mixing region 190 may include a baffle 200 (shown in FIG. 5). The baffle 200 may have a first side 205 which is a rear side. The first side 205 may be fluidly connected to the fuel inlet orifice 185 to receive mixed fuel. The baffle 200 may have a second side 210 which is a front side. The second side 210 may be proximate the burner 140. With reference to axis 215, the first side 205 and the second side 210 may be spaced in a first direction which is a transverse (T) direction. The baffle 200 may define an indirect passageway between the first side 205 and the second side 210.

The baffle 200 may include a plurality of flow barrier walls, including a first flow barrier wall 225 and a second flow barrier wall 230. With further reference to the axis 215, the plurality of flow barrier walls may extend in a second direction which is a longitudinal (L) direction. In addition, the plurality of flow barrier walls may be transversely spaced from each other. Further the plurality of flow barrier walls may have a same rectangular profile. With reference to the first flow barrier wall 225, the wall may include opposing longitudinal ends, including a first end 235 and a second end 240. In the longitudinal direction, the first end 235 may be a proximate end and the second end 240 may be a distal end.

With further reference to the axis 215 a span of the plurality of flow barrier walls in the longitudinal direction may match a longitudinal span of the burner box 14. In addition, a span of the plurality of flow barrier walls in a third direction, which is the height wise direction (H), may match a height wise span inside the burner box 14.

The plurality of flow barrier walls may include a respective plurality of flow-thru portions, including a first flow-thru portion 245 on the first flow barrier wall 225 and a second flow-thru portion 250 on the second flow barrier wall 230. The flow-thru portions may enable fluid communication in the transvers direction between the plurality of flow barrier walls. In adjacent ones of the plurality of flow barrier walls, the plurality of flow-thru portions may be disposed on opposing longitudinal ends, and may be non-overlapping in the longitudinal direction.

The above configuration may create an indirect flow path in the transverse direction between the first side 205 of the baffle 200 and the second side 210 of the baffle 200. As such, an indirect flow path may be disposed between the fuel inlet 185 in the burner box 14 and the burner 140. This indirect flow path may have the effect of elongating the flow path, which may have the further effect of increasing the upstream impedance in the system. As such, system noise may be reduced or eliminated completely.

The number of flow barrier walls may be driven by the system configuration and desired outcome. In the illustrated example there are three flow barrier walls, including a third flow barrier wall 260 having a third flow-thru portion 265. The flow through portion in each wall may not be limited to any specific dimension including width and height within the wall, neither the size of orifice in each flow through portion may be limited to any specific diameter.

The plurality of flow barrier walls may be evenly spaced in the transverse direction. When positioned in the burner box 14 the first side 205 of the baffle 200 may be proximate and upstream of the fuel inlet orifice 185. As a result, mixed fuel may be guided by the first flow barrier wall 225 toward the first flow-thru portion 245. When flowing through the third flow-thru portion 265, the third flow barrier wall 260 may guide flow to the burner 140.

The following non-limiting features further increase flow-thru impedance in the baffle 200. The percent open area of each flow through portion may not be the same for each wall. One wall may have more open area as compared to another wall within the same baffle 200, which may provide improved mixing and noise dampening capability within the system. On the other hand, a location of the flow through portion may be partially or completely reversed which may provide optimum performance.

Focusing on the first flow-thru portion 245, the portion may comprise a plurality of flow-thru orifices, including a first orifice 262 and a second orifice 264. Each of the flow-thru orifices may define a respective flow-thru area, so that the plurality of flow-thru orifices in the first flow-thru portion may define a total flow-thru area. In one embodiment, the total flow-thru area in the first flow-thru portion 245 may be less or more than fifty percent of a total surface area of the first flow-thru portion. In one embodiment the plurality of flow-thru orifices in the first flow-thru portion 245 may form a uniformly distributed rectangular array.

Interconnecting each of the plurality of flow barrier walls there may be a plurality of connector walls including a first connector wall 270 and a second connector wall 275. The plurality of connector walls may extend in the transverse direction between opposing longitudinal ends of alternative ones of the plurality of flow barrier walls. Accordingly, the baffle 200 may have a boxed-serpentine shape in a plan view. With reference to axis 251, the connector walls are not limited to sides which are along the L direction, however connector walls may be introduced at the top and the bottom of the baffle 200, along H direction, which may increase the rigidity of the baffle 200.

A plurality of flanges including a first flange 280 and a second flange 285 may extend in a transverse direction from height-wise opposing ends of each of the plurality of flow barrier walls. The plurality of flanges may provide a stable platform for the baffle 200 to sit against the top surface 105 and the bottom surface 112 of the burner box 14.

Disclosed above is an acoustical dampening baffle placed in a mixing region of the pre-mix burner system which may provide an improved system operation. The design may increase an upstream impedance in the system and allow improved mixing at a time of ignition. This may result in improved quality of ignition by reducing a thermo-acoustical response at the time of ignition. The indirect/multi-pass design may allow enhanced installation in a manufacturing environment.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A baffle for a mixing region of a furnace burner box, the mixing region being a volume in the burner box defined in a transverse direction between a burner at a front portion of the burner box and an opposing a rear portion of the burner box, a longitudinal direction between opposing side surfaces of the burner box, and a height-wise direction between opposing top and bottom surfaces of the burner box, the baffle comprising:

a first side which is a rear side, a second side which is a front side, the first side and the second side being spaced in the transverse direction, and wherein the baffle defines an indirect fluid passageway between the first side and the second side;

wherein;

the baffle includes a plurality of flow barrier walls, including a first flow barrier wall and a second flow barrier wall, the plurality of flow barrier walls extending in the longitudinal direction, being transversely spaced from each other and including a same geometric profile, wherein the plurality of flow barrier walls includes a respective plurality of flow-thru portions, including a first flow-thru portion on the first flow barrier wall and a second flow-thru portion on the second flow barrier wall, the plurality of flow-thru portions fluidly connecting the plurality of flow barrier walls in the transverse direction, and wherein in transversely adjacent ones of the plurality of flow barrier walls, the plurality of flow-thru portions are disposed on opposing longitudinal ends and are non-overlapping in the longitudinal direction, and the baffle further includes a plurality of connector walls interconnecting each of the plurality of flow barrier walls, the plurality of connector walls extending in the transverse direction between opposing longitudinal ends of alternative ones of the plurality of flow barrier walls, so that the baffle has a boxed-serpentine shape in a plan view.

2. The baffle of claim 1 wherein the plurality of flow barrier walls are evenly spaced in the transverse direction.

3. The baffle of claim 2 wherein each of the plurality of flow-thru portions comprises a total longitudinal span of less than fifty percent of a longitudinal span of each of the respective plurality of flow barrier walls.

4. The baffle of claim 3 wherein each of the plurality of flow-thru portions comprises a same longitudinal span.

5. The baffle of claim 4 wherein each of the plurality of flow-thru portions comprises a same configuration.

6. The baffle of claim 5 wherein the first flow-thru portion comprises a plurality of flow-thru orifices.

7. The baffle of claim 6 wherein each of the flow-thru orifices defines a respective flow-thru area, wherein the plurality of flow-thru orifices in the first flow-thru portion defines a total flow-thru area, wherein the total flow-thru area in the first flow-thru portion is less than fifty percent of a total surface area of the first flow-thru portion.

8. The baffle of claim 7 wherein the plurality of flow-thru orifices in the first flow-thru portion form a uniformly distributed rectangular array.

9. A furnace comprising:

a burner box, the burner box including a mixing region, the mixing region being a volume in the burner box, the volume defined in a transverse direction between a burner at a front portion of the burner box and an opposing a rear portion of the burner box, a longitudinal direction between opposing side surfaces of the burner box, and a height-wise direction between opposing top and bottom surfaces of the burner box, the mixing region including a baffle, the baffle comprising:

a first side which is a rear side, a second side which is a front side, the first side and the second side being spaced in the transverse direction, and wherein the baffle defines an indirect fluid passageway between the first side and the second side;

wherein;

the baffle includes a plurality of flow barrier walls, including a first flow barrier wall and a second flow barrier wall, the plurality of flow barrier walls extending in the longitudinal direction, being transversely spaced from each other and including a same geometric profile, wherein the plurality of flow barrier walls includes a respective plurality of flow-thru portions, including a first flow-thru portion on the first flow barrier wall and a second flow-thru portion on the second flow barrier wall, the plurality of flow-thru portions fluidly connecting the plurality of flow barrier walls in the transverse direction, and wherein a transversely adjacent ones of the plurality of flow barrier walls, the plurality of flow-thru portions are disposed on opposing longitudinal ends and are non-overlapping in the longitudinal direction;

wherein the furnace further comprises a plurality of connector walls interconnecting each of the plurality of flow barrier walls, the plurality of connector walls extending in the transverse direction between opposing longitudinal ends of alternative ones of the plurality of flow barrier walls, so that the baffle has a boxed-serpentine shape in a plan view.

10. The furnace of claim 9 wherein the plurality of flow barrier walls are evenly spaced in the transverse direction.

11. The furnace of claim 10 wherein each of the plurality of flow-thru portions comprises a total longitudinal span of less than fifty percent of a longitudinal span of each of the respective plurality of flow barrier walls.

12. The furnace of claim 11 wherein each of the plurality of flow-thru portions comprises a same longitudinal span.

13. The furnace of claim 12 wherein each of the plurality of flow-thru portions comprises a same configuration.

14. The furnace of claim 13 wherein the first flow-thru portion comprises a plurality of flow-thru orifices.

15. The furnace of claim 14 wherein each of the flow-thru orifices defines a respective flow-thru area, wherein the plurality of flow-thru orifices in the first flow-thru portion defines a total flow-thru area, wherein the total flow-thru area in the first flow-thru portion is less than fifty percent of a total surface area of the first flow-thru portion.

16. The furnace of claim 15 wherein the plurality of flow-thru orifices in the first flow-thru portion form a uniformly distributed rectangular array.

* * * * *